US011432693B2

(12) United States Patent
Paulla

(10) Patent No.: US 11,432,693 B2
(45) Date of Patent: Sep. 6, 2022

(54) VACUUM CLEANER

(71) Applicant: Techtronic Cordless GP, Anderson, SC (US)

(72) Inventor: Kirti Kant Paulla, Charlotte, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 17/136,424

(22) Filed: Dec. 29, 2020

(65) Prior Publication Data

US 2021/0282611 A1 Sep. 16, 2021

Related U.S. Application Data

(60) Provisional application No. 62/988,660, filed on Mar. 12, 2020.

(51) Int. Cl.
*A47L 9/16* (2006.01)

(52) U.S. Cl.
CPC ..... *A47L 9/1625* (2013.01); *A47L 9/1683* (2013.01); *A47L 9/1691* (2013.01)

(58) Field of Classification Search
CPC ..... A47L 5/26; B04C 2009/005; B04C 2009/008; B01D 45/12; B01D 45/16
USPC ..... 15/344
See application file for complete search history.

(56) References Cited

U.S. PATENT DOCUMENTS 6,312,594 B1 * 11/2001 Conrad ..... B04C 3/00 55/459.3
6,461,508 B1 10/2002 Thomson
7,815,702 B2 10/2010 Hyun et al.
8,657,910 B2 2/2014 Park et al.
10,294,067 B1 5/2019 DeBellis
10,441,124 B2 5/2019 DeBellis
10,517,453 B2 * 12/2019 Hyun ..... A47L 9/1666
(Continued)

FOREIGN PATENT DOCUMENTS

AU 2009238258 B2 2/2015
CN 100548436 C 10/2009
(Continued)

OTHER PUBLICATIONS

International Search Report and Written Opinion for Application No. PCT/US2020/067279 dated Mar. 17, 2021 (14 pages).

*Primary Examiner* — Joseph J Hail
*Assistant Examiner* — Robert C Moore
(74) *Attorney, Agent, or Firm* — Michael Best & Friedrich LLP

(57) ABSTRACT

A vacuum cleaner comprising a suction source operable to generate an airflow, a first stage cyclonic separator configured to separate debris from the airflow, the airflow rotatable about a first stage separator axis in the first stage separator to separate the debris from the airflow, a second stage cyclonic separator downstream from the first stage cyclonic separator, the second stage cyclonic separator configured to separate debris from the airflow, a first stage collector configured to receive debris from the first stage cyclonic separator, and a second stage collector configured to receive debris from the second stage cyclonic separator, the second stage collector being within the first stage collector, the second stage collector having a cross section taken normal to the first stage separator axis that is polygonal.

22 Claims, 10 Drawing Sheets

(56) References Cited

U.S. PATENT DOCUMENTS

| | | | | |
|---|---|---|---|---|
| 2007/0163073 | A1* | 7/2007 | Sepke | A47L 9/1658 15/352 |
| 2010/0162517 | A1 | 7/2010 | Han et al. | |
| 2015/0020348 | A1 | 1/2015 | Miefalk et al. | |
| 2018/0333021 | A1 | 11/2018 | Bohlen et al. | |
| 2019/0090709 | A1 | 3/2019 | Hyun et al. | |
| 2019/0320863 | A1 | 10/2019 | Conrad | |

FOREIGN PATENT DOCUMENTS

| | | | |
|---|---|---|---|
| CN | 102438496 | B | 5/2014 |
| CN | 104105435 | A | 10/2014 |
| CN | 108463151 | A | 8/2018 |
| CN | 208447457 | U | 2/2019 |
| CN | 110475495 | A | 11/2019 |
| CN | 110475496 | A | 11/2019 |
| CN | 110475497 | A | 11/2019 |
| CN | 110520026 | A | 11/2019 |
| EP | 2471429 | A2 | 7/2012 |
| WO | 2018038351 | A1 | 3/2018 |
| WO | 2018188734 | A1 | 10/2018 |

* cited by examiner

VACUUM CLEANER

CROSS-REFERENCE TO RELATED APPLICATIONS

This application claims priority to U.S. Provisional Patent Application No. 62/988,660, filed Mar. 12, 2020, the entire contents of which are hereby incorporated by reference herein.

BACKGROUND

The present invention relates generally to vacuum cleaners including debris collectors. The present invention relates more specifically to vacuum cleaners including multiple debris collectors where at least one of the debris collectors includes a polygonal cross section having vertices.

SUMMARY

In one aspect, a vacuum cleaner includes a suction source operable to generate an airflow, a first stage cyclonic separator configured to separate debris from the airflow, the airflow rotatable about a first stage separator axis in the first stage separator to separate the debris from the airflow, a second stage cyclonic separator downstream from the first stage cyclonic separator, the second stage cyclonic separator configured to separate debris from the airflow, a first stage collector configured to receive debris from the first stage cyclonic separator, and a second stage collector configured to receive debris from the second stage cyclonic separator, the second stage collector being within the first stage collector, the second stage collector having a cross section taken normal to the first stage separator axis that is polygonal.

In another independent aspect, a vacuum cleaner includes a suction source operable to generate an airflow, a first stage cyclonic separator configured to separate debris from the airflow, the airflow rotatable about a first stage separator axis in the first stage separator to separate the debris from the airflow, a second stage cyclonic separator downstream from the first stage cyclonic separator, the second stage cyclonic separator configured to separate debris from the airflow, a first stage collector configured to receive debris from the first stage cyclonic separator, and a second stage collector configured to receive the debris from the second stage cyclonic separator, the second stage collector being within the first stage collector, the second stage collector having a cross section taken normal to the first stage separator axis that includes vertices.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
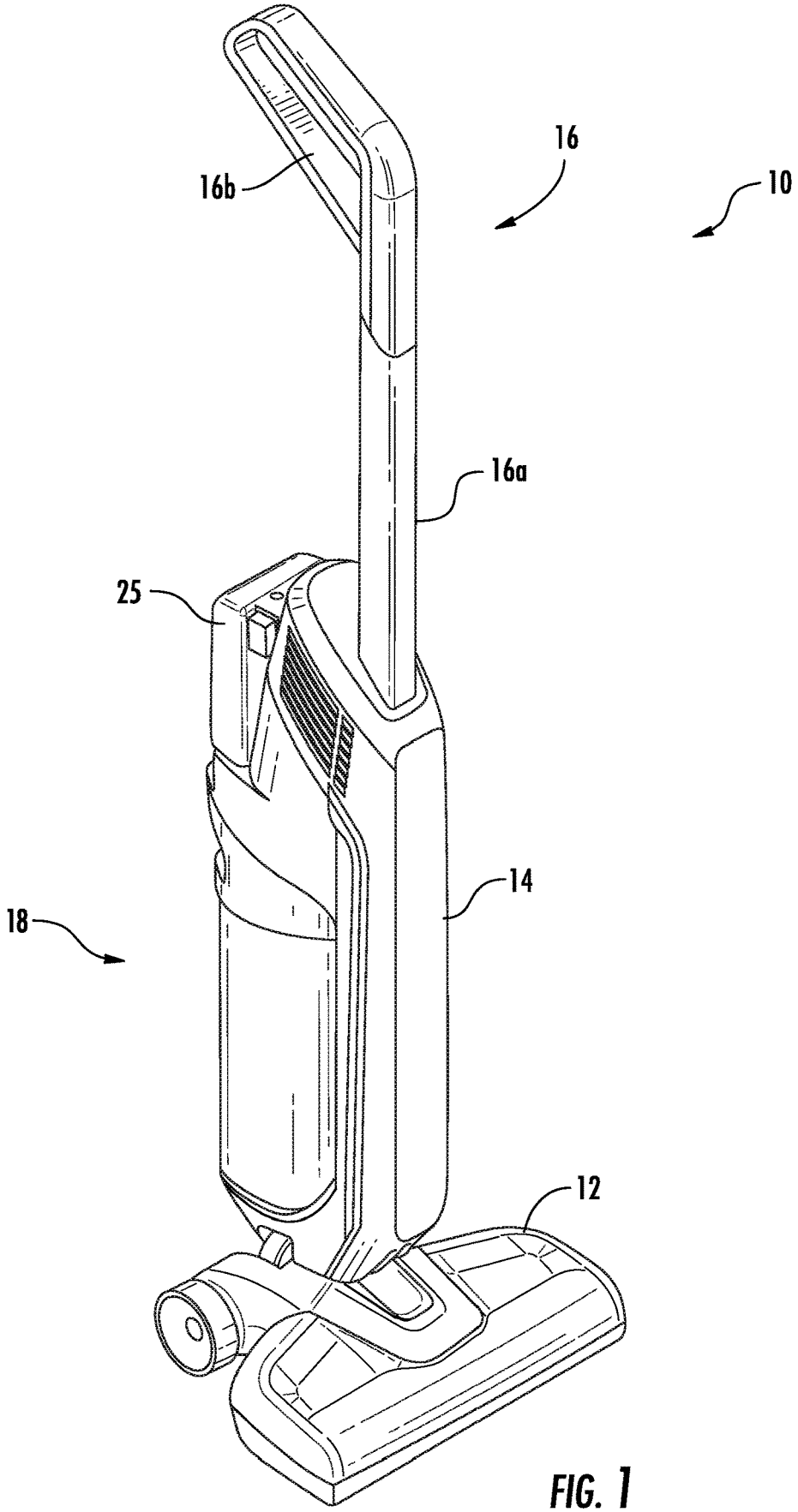
FIG. 1 is a perspective view of a vacuum cleaner having a separator.
Figure 2:
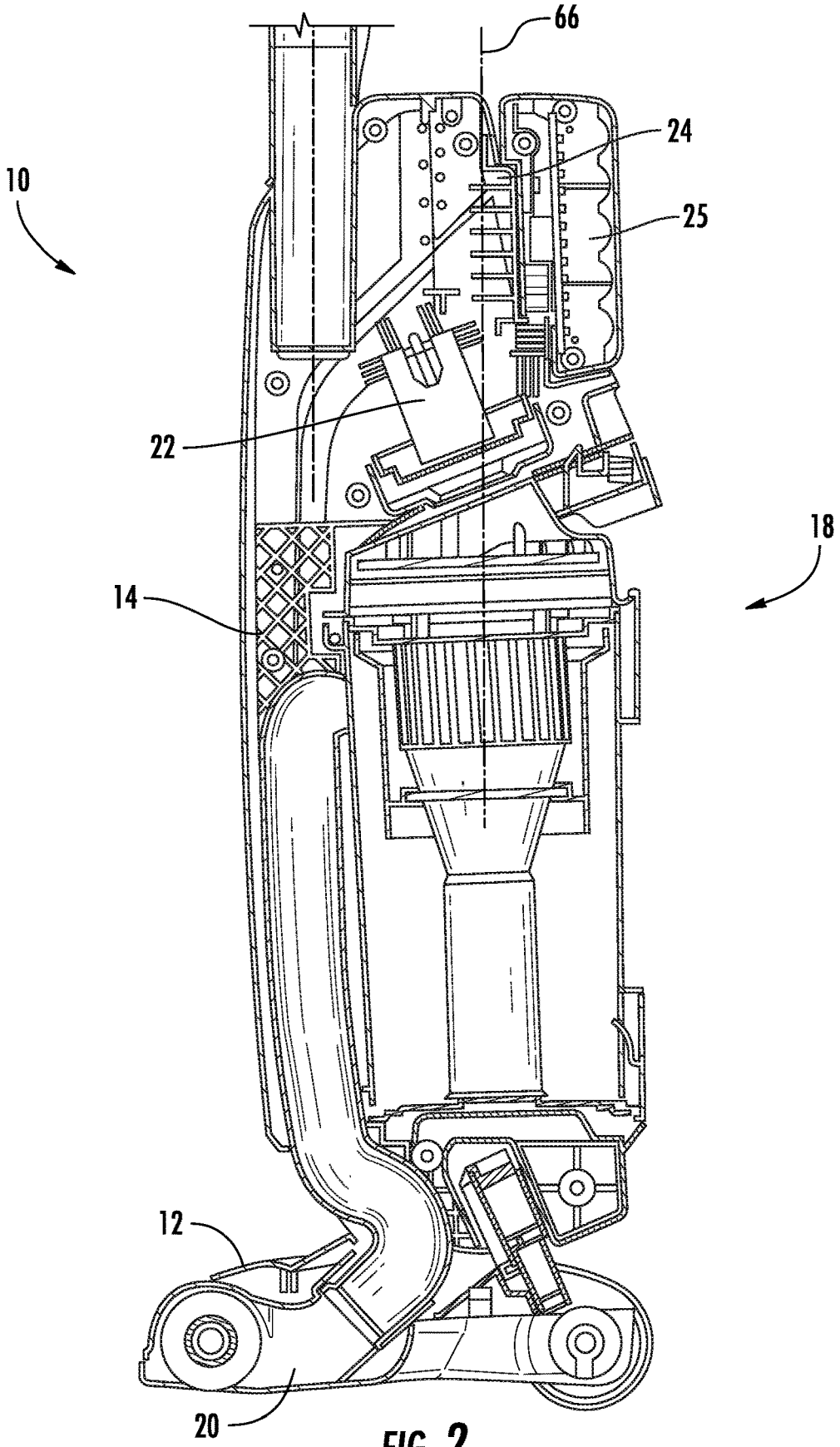
FIG. 2 is a cross sectional view of the vacuum cleaner of FIG. 1 taken from a midpoint between lateral sides of the vacuum cleaner.

FIGS. 1 and 2 illustrate a vacuum cleaner 10 according to one embodiment. The vacuum cleaner 10 includes a foot or cleaning head 12. A body 14 is pivotably connected to the cleaning head 12. The vacuum cleaner 10 includes a handle 16. The handle has a shaft portion 16*a* extending from the body 14 and a grip portion 16*b* extending from the shaft portion 16*a* (e.g., at an oblique angle relative to the shaft portion 16*a*). A separator assembly 18 is supported by the body 14. The illustrated vacuum cleaner 10 is an upright style vacuum cleaner. In other embodiments, the vacuum cleaner 10 may include other form factors (e.g., handheld, canister, etc.).

With continued reference to FIG. 2, the cleaning head 12 includes a suction inlet 20. The body 14 supports a suction source 22 operable to generate an airflow through the suction inlet 20 to draw debris with the airflow through the suction inlet 20. The separator assembly 18 is downstream from the suction inlet 20 and separates debris from the airflow.

The vacuum cleaner 10 may include a battery mount 24 capable of engaging a battery 25 for supplying power to the vacuum cleaner 10 to drive the flow of debris and airflow through the separator assembly 18. In other embodiments, the vacuum cleaner 10 may include a power cord to supply power to the vacuum cleaner 10 (e.g., via a wall outlet).

Figure 3:
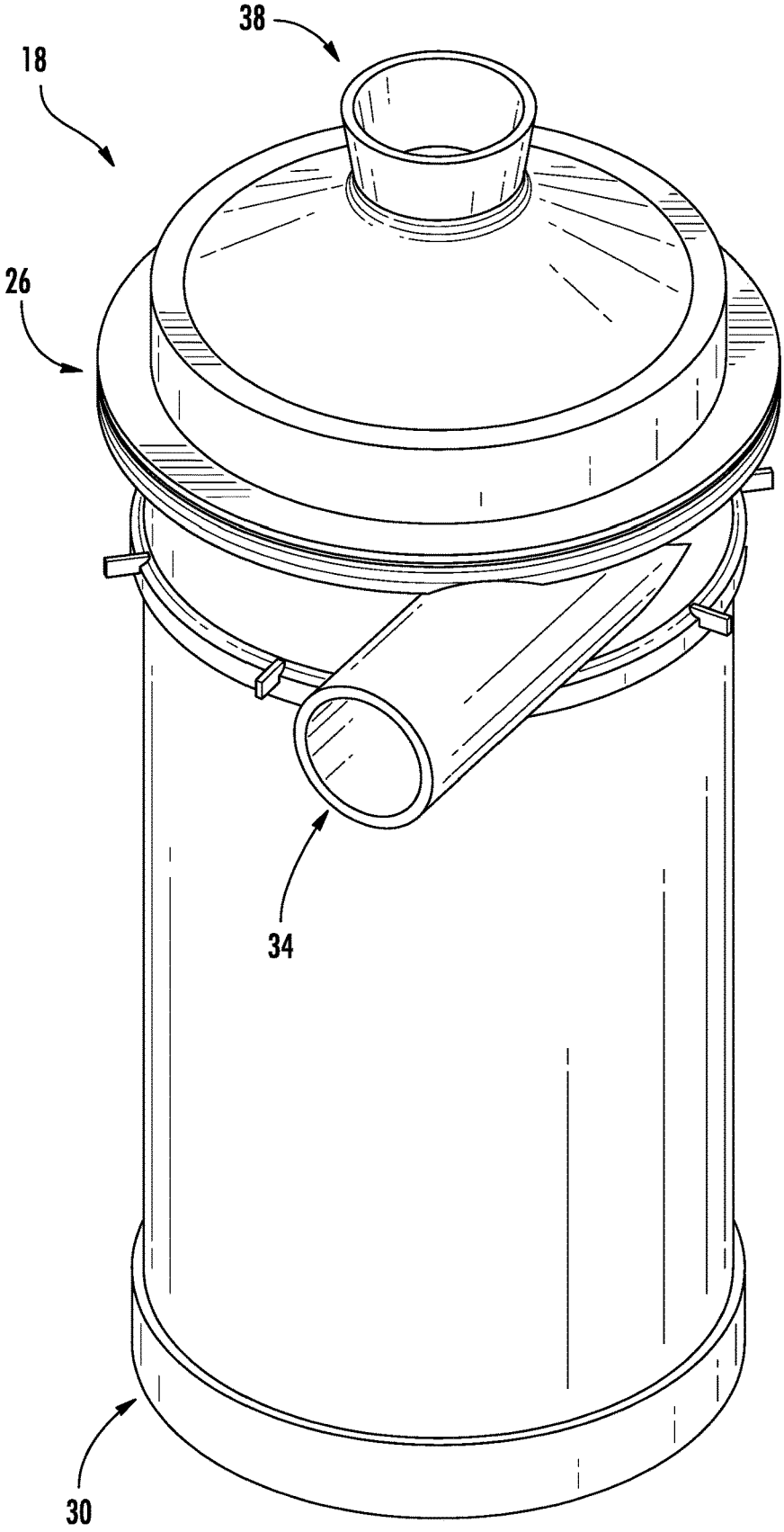
FIG. 3 is a perspective view of the separator assembly of the vacuum cleaner of FIG. 1.
Figure 4:
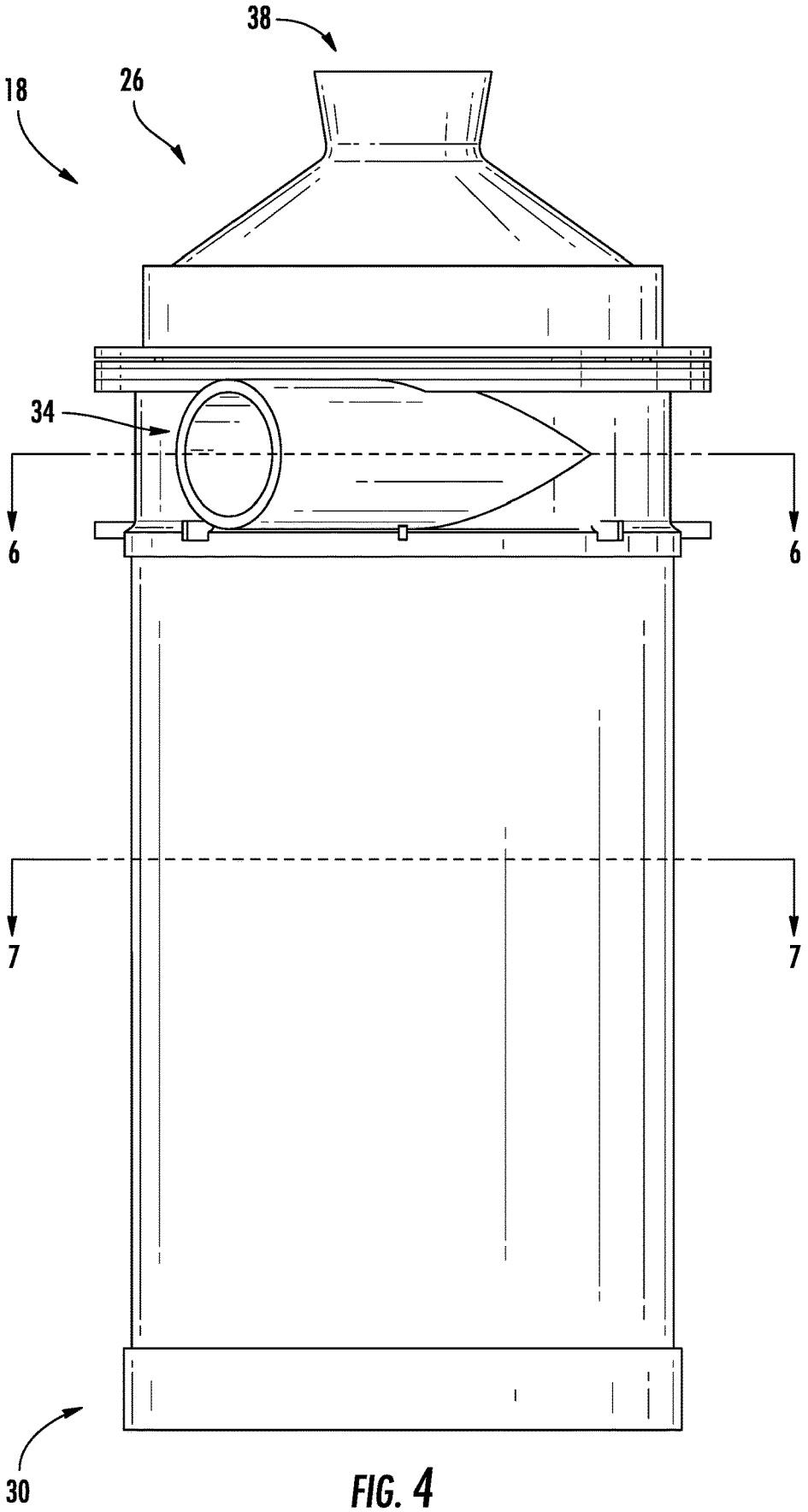
FIG. 4 is a side view of the separator assembly of FIG. 3.
Figure 5:
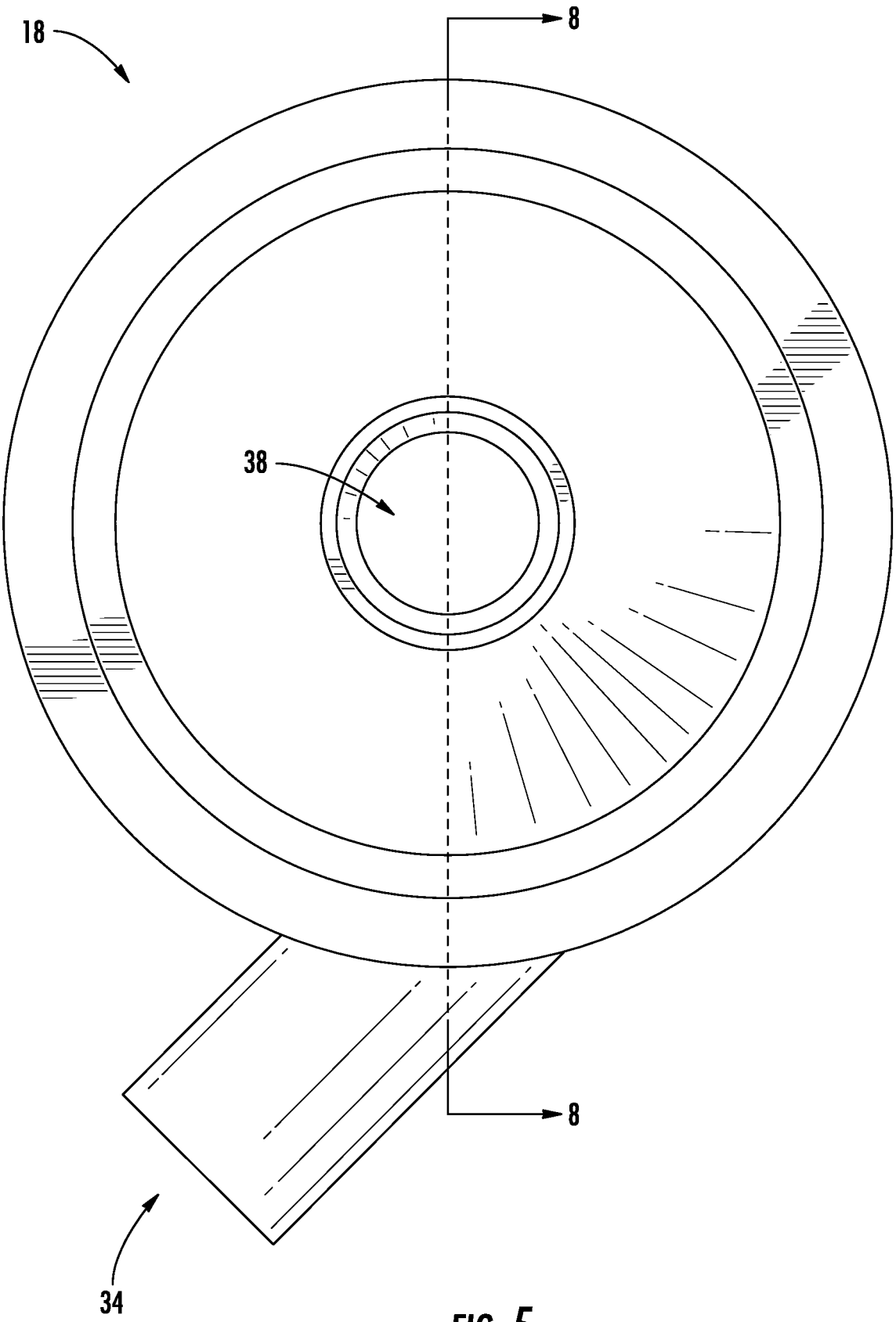
FIG. 5 is a top view of the separator assembly of FIG. 3.

As seen in FIG. 3, the separator assembly 18 includes an inlet end 26 and a collector end 30. As seen in FIG. 2, the separator assembly 18 is housed within the vacuum cleaner 10 with the inlet end 26 closer to the handle 16 and the collector end 30 closer to the suction inlet 20. An inlet 34 of the separator assembly 18 is in fluid communication with the suction inlet 20. An outlet 38 of the separator assembly 18 is in fluid communication with the suction source 22. An airflow having debris from the suction inlet 20 passes through the inlet 34 of the separator assembly 18. The separator assembly 18 serves to remove debris from the airflow, which exits the outlet 38 towards the suction source 22.

Referring to FIGS. 3-13, the illustrated separator assembly 18 includes a first stage cyclonic separator 42, a second stage cyclonic separator 46, a first stage collector 50, and a second stage collector 54. The second stage cyclonic separator 46 includes an inlet end 58 and an outlet end 62. An axis 66 (i.e., a first stage separator axis) is defined by the first stage cyclonic separator 42. Airflow rotating within the first stage cyclonic separator 42 rotates about the axis 66. Rotation about the axis 66 separates debris from the airflow. The debris separated by the first stage cyclonic separator 42 is retained in the first stage collector 50. Airflow passes through the outlet 38 of the separator assembly 18. In the illustrated embodiment, the axis 66 also extends through a center point 70 of the inlet end 58 and a center point 74 of the outlet end 62 of the second stage cyclonic separator 46. The first stage collector 50 is configured to receive debris from the first stage cyclonic separator 42. The second stage collector 54 is configured to receive debris from the second stage cyclonic separator 46. The second stage collector 54 is within the first stage collector 50. The second stage collector 54 has a cross section 86 taken normal to the axis 66 that is polygonal. In other words, the cross section 86 taken normal to the axis 66 of the second stage collector 54 includes vertices. In some embodiments, the second stage cyclonic separator 46 is multi-cyclonic and receives debris from a plurality of second stage cyclones at the inlet end 58. In the illustrated embodiment, the second stage cyclonic separator is a single cyclone.

Figure 7:
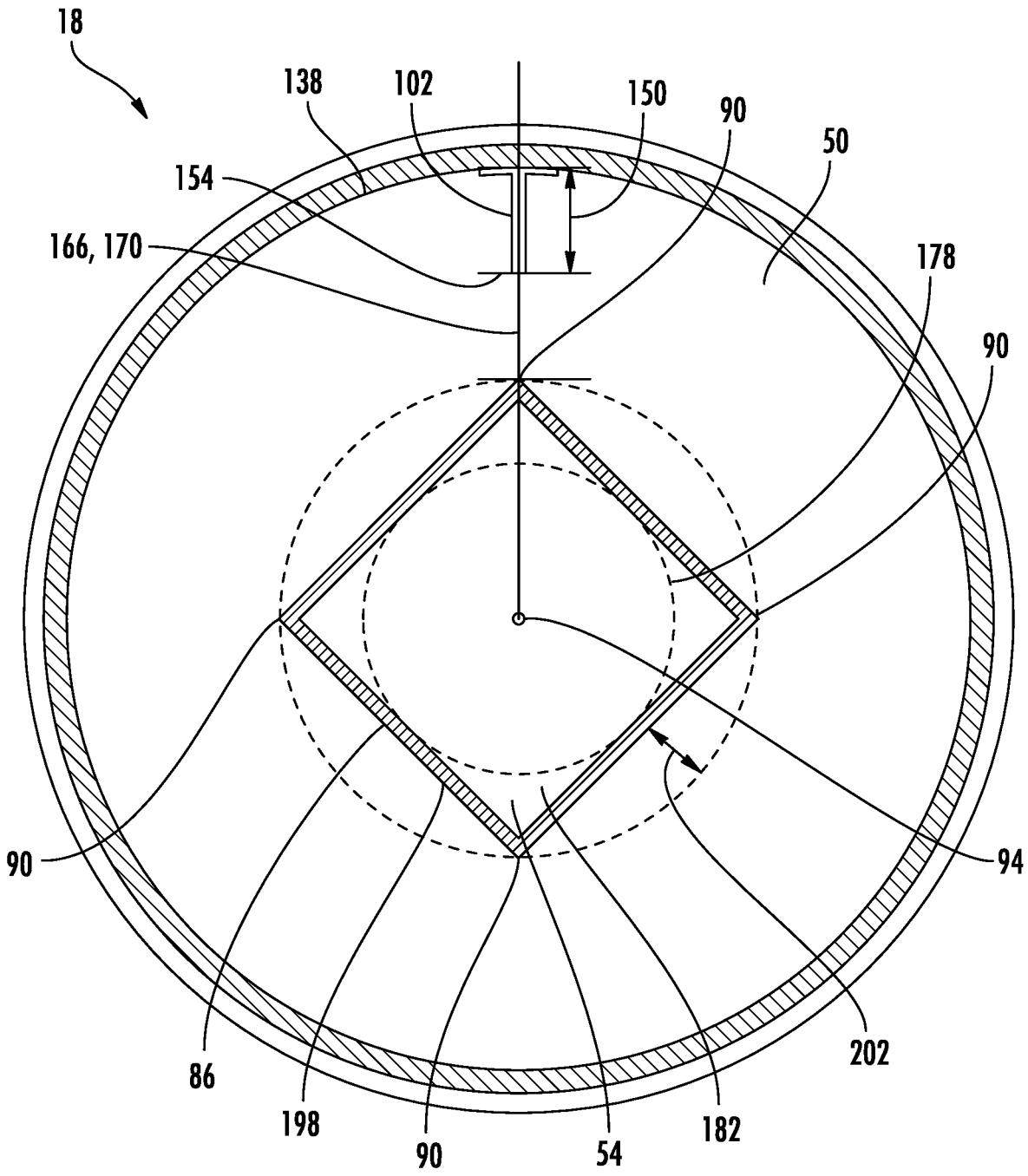
FIG. 7 is a cross-sectional view of the separator assembly of FIG. 2 taken from line 7-7 in FIG. 5.

The cross section 86 in the illustrated embodiment is polygonal and has at least three vertices 90. The cross section 86 may include regular or irregular triangles, rectangles or squares, regular or irregular pentagons, and regular or irregular hexagons. In some embodiments, the centroid 94 of the cross section 86 is located on the axis 66. As illustrated in FIG. 7, the cross section 86 of the second stage collector 54 is a square, and the centroid of the cross section 86 is located on the axis 66. In other embodiments, the cross section 86 has a number of vertices 90 within a range including and between three and six. In one embodiment, the cross section 86 has more than six vertices. Optimally, the cross section 86 has at least three and no more than six vertices 90. This allows the benefits of the polygonal cross section 86 to be achieved, while the cross section 86 does not tend to resemble a circle.

Figure 6:
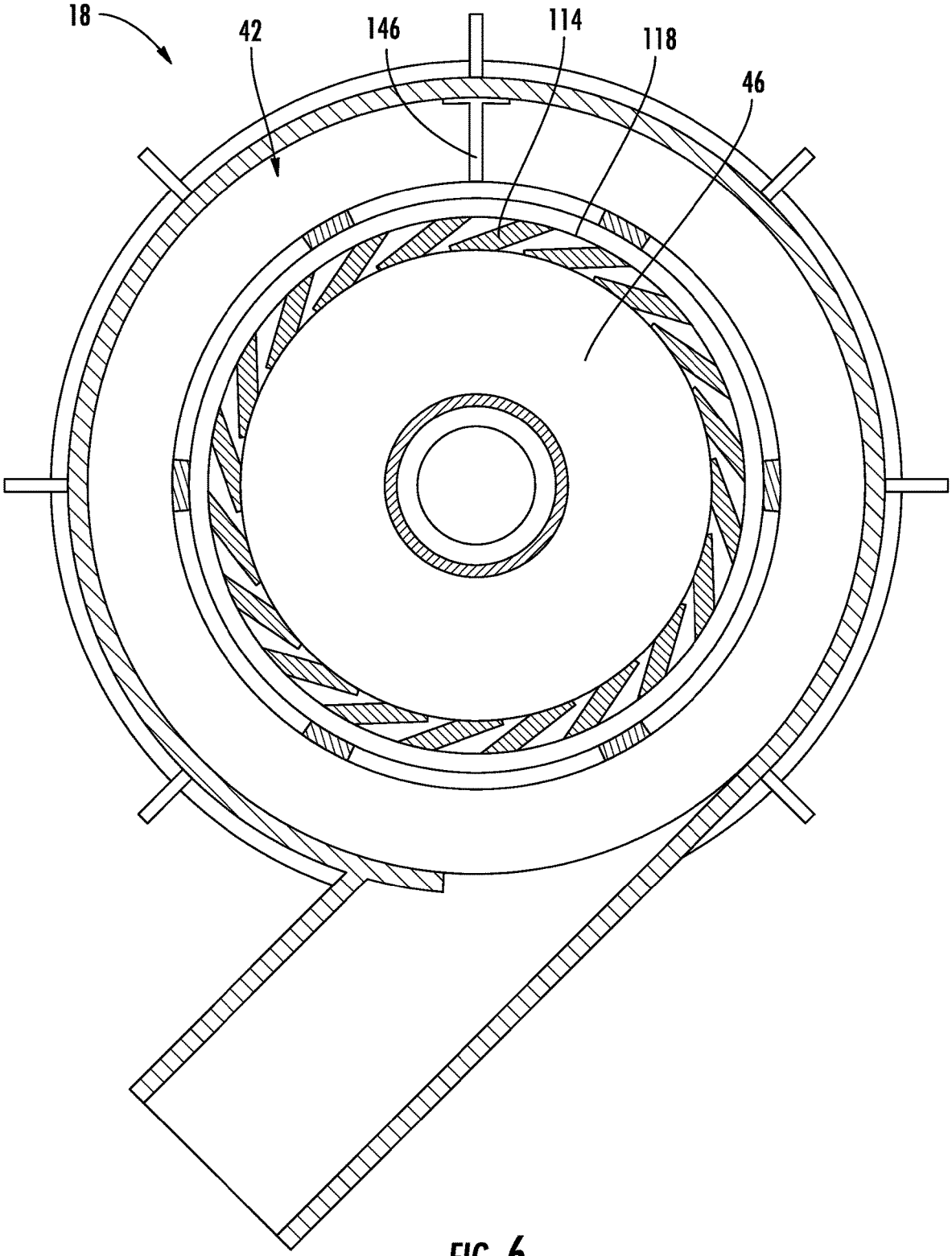
FIG. 6 is a cross-sectional view of the separator assembly of FIG. 2 taken from line 6-6 in FIG. 5.
Figure 8:
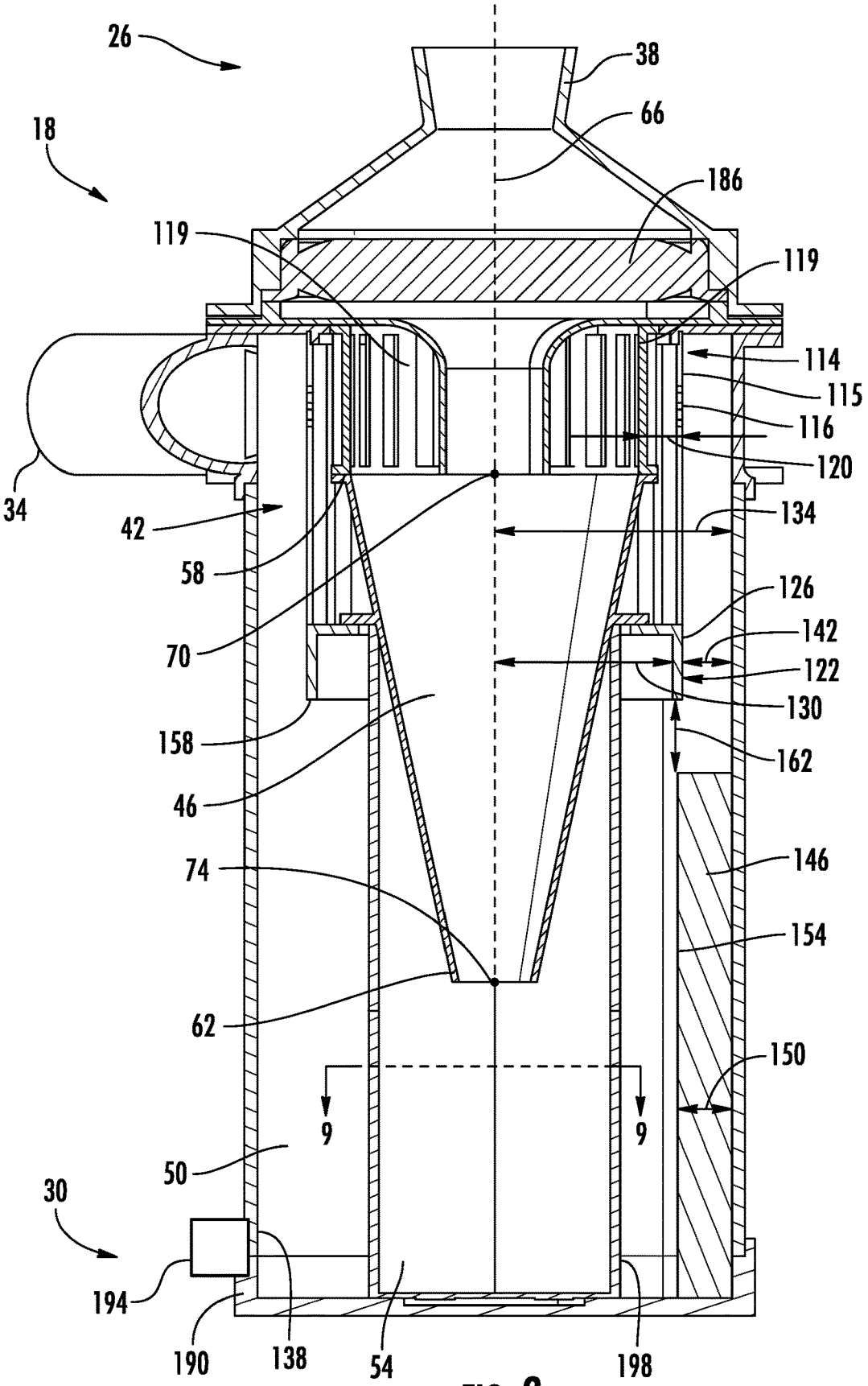
FIG. 8 is a cross-sectional view of the separator of FIG. 2 taken from line 11-11 in FIG. 8 and illustrating a first stage separator axis.
Figure 9A:
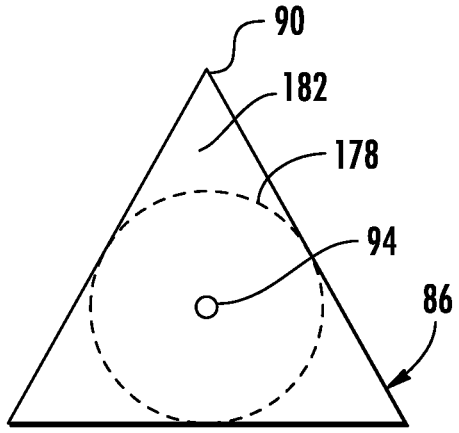
FIGS. 9A-9D are schematic cross-sectional views of a cross section taken from line 9-9 in FIG. 8.
Figure 9B:
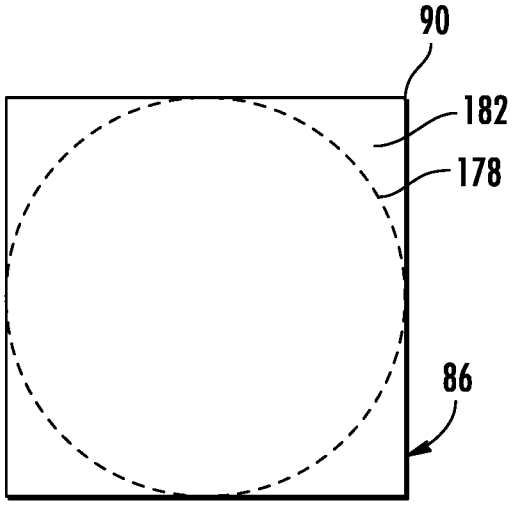
Figure 9C:
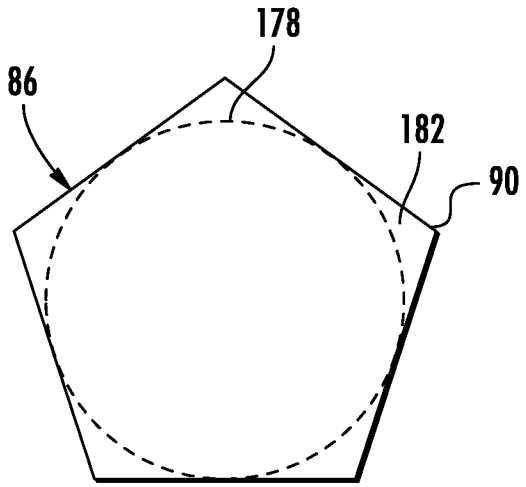
Figure 9D:
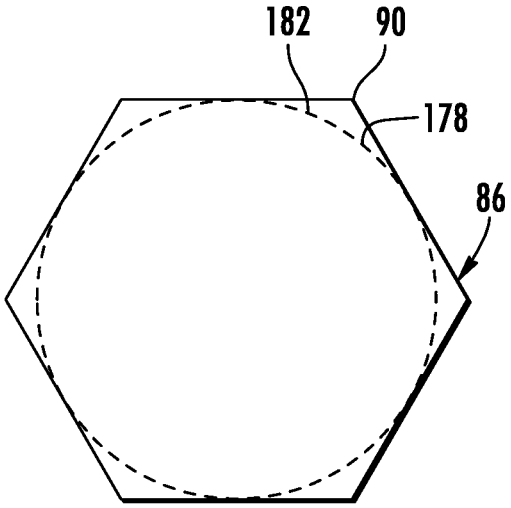

With reference to FIGS. 6 and 8, the separator assembly 18 further includes a shroud 114 which forms a passageway 118 between the first stage cyclonic separator 42 and the second stage cyclonic separator 46. The shroud 114 includes a screen 115 with a plurality of openings 116 through which the airflow must pass before reaching the inlet end 58 of the second stage cyclonic separator 46. The screen 115 extends around the first stage separator axis 66. The screen 115 may be a perforated metal mesh with punched or etched pores. Alternatively, the screen 115 may be a wire or fiber mesh. In yet other embodiments, the screen 115 may be made of perforated plastic. The inlet end 58 of the second stage cyclonic separator 46 includes vanes 119. In the illustrated embodiment, there is a radial gap 120 between the mesh screen 115 and the vanes 119, such that the mesh screen 115 does not press directly against the vanes 119. The shroud 114 includes a skirt 122 with a distal surface 126 spaced farthest from the axis 66.

The skirt 122 extends from the shroud 114 towards the collector end 30 of the separator assembly 18. A skirt distance 130 is measured normal to the axis 66 between the distal surface 126 and the axis 66. A first stage collector distance 134 is measured between the axis 66 and a wall 138 of the first stage collector 50. The first stage collector distance 134 is measured from the axis 66 to the interior side of the wall 138. The skirt distance 130 is shorter than the first stage collector distance 134. The difference between the skirt distance 130 and the first stage collector distance 134 defines a gap 142. The gap 142 forms an entry to the first stage collector 50 from the first stage cyclonic separator 42. The gap 142 may be between 2.5% and 7.5% of the first stage collector distance 134. The second stage collector 54 extends between the shroud 114 and the collector end 30 of the dust separator assembly 18.

In the illustrated embodiment, the second stage collector 54 is polygonal between the skirt 122 and the collector end 30 of the separator assembly 18. The polygonal shape of the second stage collector 54 inhibits swirling of the airflow in the first stage collector 50. The polygonal shape of the second stage collector 54 also inhibits re-entrainment of debris into the airflow in the second stage collector 54.

The second stage collector 54 is positioned within the first stage collector 50. In the illustrated embodiment, the first stage collector 50 is generally cylindrical, the cylinder aligned with the axis 66. The first stage collector 50 defines a cylindrical housing of the separator assembly 18. The first stage collector 50 surrounds the axis 66. In the illustrated embodiment, the second stage collector 54 is positioned centrally within the first stage collector 50 with a centroid of the cross section 86 located on the axis 66.

As illustrated in FIGS. 6-8 and 10, the separator assembly 18 may further include a rib 146. The rib 146 is positioned within the first stage collector 50. The rib 146 extends along the first stage separator axis 66 projecting from the wall 138 of the first stage collector 50 towards the axis 66. In one embodiment, the rib 146 extends radially from the interior side of the wall 138 towards the axis 66. The rib 146 extends a rib dimension 150 to a rib tip 154 closest to the axis 66. In the illustrated embodiment, the separator assembly 18 includes a single rib 146. In other embodiments, the separator assembly 18 includes more than one rib 146.

The rib dimension 150 may be larger or smaller than the gap 142 between the wall 138 of the first stage collector 50 and the distal surface 126 of the skirt 122. With the rib dimension 150 larger than the gap 142, the rib tip 154 is closer to the axis 66 than the distal edge 126 of the skirt 122. In the illustrated embodiment, the rib dimension 150 is approximately the same as the gap 142. In other embodiments, the rib dimension 150 is greater than the gap 142 by between 0% and 50% of the dimension of the gap 142. In other embodiments, the rib dimension is greater than the gap 142 by between 15% and 35% of the dimension of the gap 142.

The rib 146 projects in a direction parallel to the axis 66. The rib 146 projects from the collector end 30 of the separator assembly 18 to a position between the inlet end 26 of the separator assembly 18 and the collector end 30 of the separator assembly 18. More specifically, the rib 146 projects from the collector end 30 to a position between the collector end 30 and a surface 158 of the skirt 122. The surface 158 faces the collector end 30 and is closest (i.e., proximal) to the collector end 30. As the rib 146 does not project the full length between the collector end 30 and the skirt 122, a void 162 is defined between the surface 158 of the skirt 122 and the rib 146. This void 162 permits the passage of fluid and debris there through. The length of the void 162 between the surface 158 of the skirt 122 and the rib 146 parallel to the axis 66 is between 0% and 200% of the rib dimension 150. In other embodiments, the length of the void 162 is between 25% and 125% of the rib dimension 150.

Figure 10:
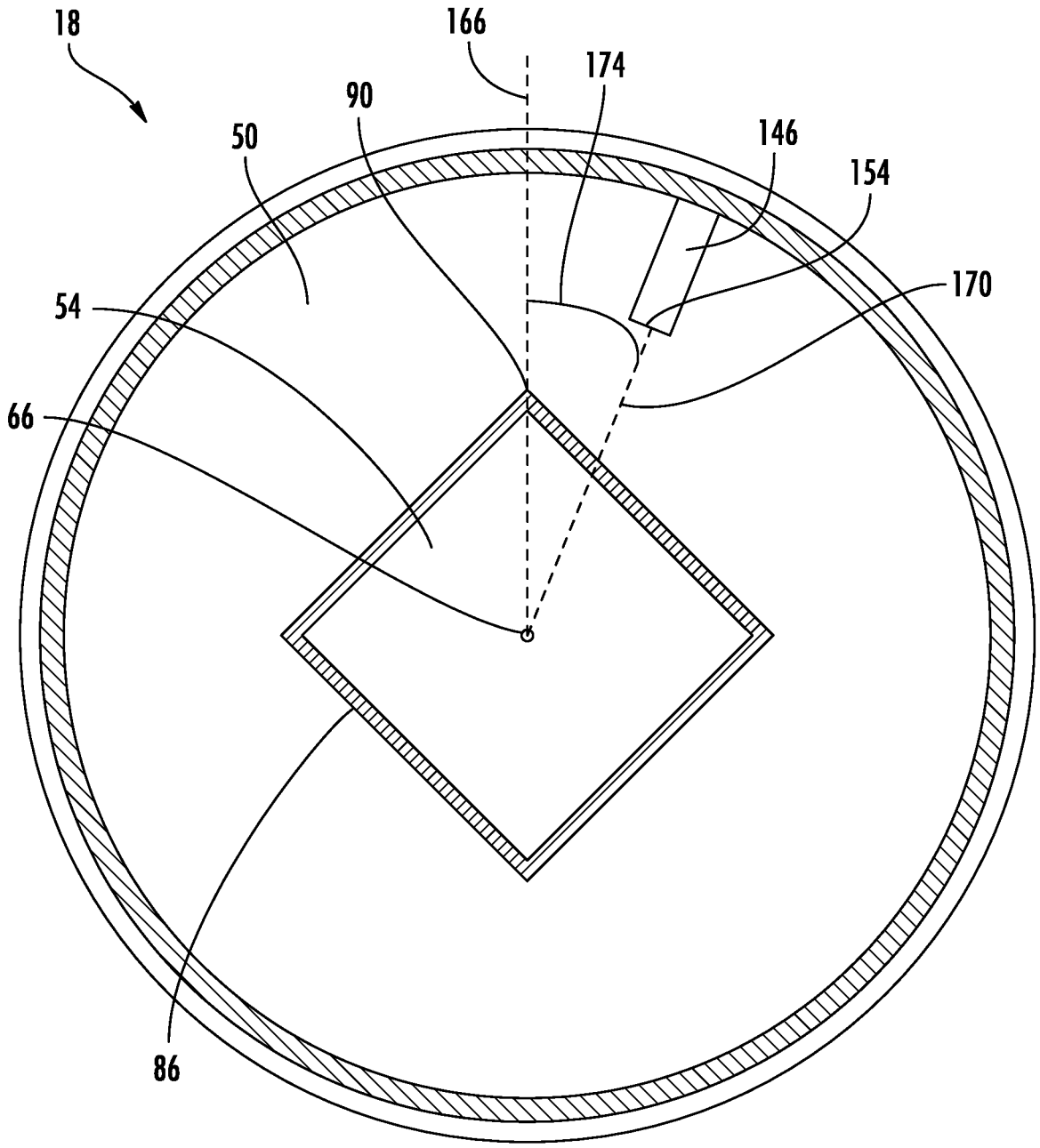
FIG. 10 is a cross-sectional view of an alternate separator assembly having a rib disposed at an angle relative to a vertex of the second stage collector, the cross section taken from line 7-7 in FIG. 5.

As shown in FIG. 7, the rib tip 154 may be aligned with the vertex 90 of the cross section 86 of the second stage collector 54. As shown in FIG. 10, the rib tip 154 may also be displaced from (i.e., angled relative to) a vertex 90 of the cross section 86 of the second stage collector 54. A vertex line 166 extends through the axis 66 and the vertex 90 of the cross section 86. A rib tip line 170 extends through the axis 66 and the rib tip 154. An angle 174 is defined between the vertex line 166 and the rib tip line 170. In the embodiment illustrated in FIG. 7, the angle 174 is zero degrees, the vertex line 166 is aligned with the rib tip line 170, and the rib 146 extends towards the vertex 90. The angle 174 may be less than thirty degrees. In the embodiment illustrated in FIG. 10, the angle 174 is around twenty degrees. The angle 174 may be less than ten degrees.

As seen in FIG. 9A-9D, a circular flow of fluid 178 within the second stage collector 54 is bound by the cross sectional shape of the second stage collector 54. The air and debris within the second stage collector 54 moves in a cyclonic, generally circular direction as it is received from the second cyclonic separator 46. As the cross sectional shape of the second stage collector 54 is polygonal and includes vertices 90, dead regions 182 are located external to the circular flow of fluid 178 and within the second stage collector 54. The dead regions 182 are adjacent the vertices 90. At least some of the debris from the circular flow of fluid 178 within the second stage collector 54 exits the circular flow of fluid 178 and is retained in the dead regions 182. This prevents the debris from being re-entrained in exiting airflow and deposited in a pre-motor filter 186 of the vacuum 10. The pre-motor filter 186 is positioned between the separator assembly 18 and the suction source 22.

As less debris is deposited in the pre-motor filter 186, the vacuum 10 is run more efficiently, and the need to clean and/or replace the pre-motor filter 186 is reduced. Subsequently, the polygonal second stage collector 54 has increased separation efficiency when compared to similar cylindrical second stage collectors. In one embodiment, the separation efficiency of the separator assembly 18 was increased from 98.6% with a circular cross-section second stage collector 54 to 99.3% with a square cross-section second stage collector 54. While appearing to be a small efficiency improvement, the effect on the pre-motor filter 186 loading is meaningful and increases filter life by between 30% and 50%.

Increasing separation efficiency of the separator assembly 18 eliminates the need for other separation efficiency increasing means. Comparable increases in separation efficiency are achieved in the prior art by adding vortex stabilizers at the outlet end 62 of the second stage cyclonic separator 46 and within the second stage collector 54. The polygonal second stage collector 54 eliminates the need for these separation efficiency increasing means thereby reducing complexity and associated cost.

In a plane normal to the axis 66, a first circle bounded by interior surfaces of the first stage collector has a first diameter and a second circle bounded by the interior surfaces of the second stage collector has a second diameter, wherein the second diameter is between 20% and 50% of the first diameter. In other embodiments, the radius of the circular flow of fluid 178 may be between 30% and 40% the first stage collector distance 134. In one embodiment, the circular flow of fluid 178 inside the second stage collector 54 has a radius ⅓ of the first stage collector distance 134.

With reference to FIG. 8, a dust cap 190 positioned adjacent the collector end 30 is removably coupled to the separator assembly 18. In some embodiments, the dust cap 190 is rotatable about a hinge 194 to permit access to the first stage collector 50 and the second stage collector 54. Debris such as hair is retained in the first stage collector during use of the vacuum cleaner 10. The debris swirls in a circular motion within the first stage collector 50 and around the second stage collector 54. The polygonal cross section 86 of the second stage collector 54 having vertices 90 permits hair to engage the vertices 90 and be wrapped around the second stage collector 54 relatively loosely. As a result, hair is wrapped around an outer surface 198 of the second stage collector 54 with a debris gap 202 between the hair and the outer surface 198. The debris gap 202 is illustrated in FIG. 7. The user can remove the hair by extending a finger or implement through the debris gap 202.

Various features and advantages of the invention are set forth in the following claims.

What is claimed is:

1. A vacuum cleaner comprising:

a suction source operable to generate an airflow;

a first stage cyclonic separator configured to separate debris from the airflow, the airflow rotatable about a first stage separator axis in the first stage separator to separate the debris from the airflow, the first stage cyclonic separator including a wall surrounding the first stage separator axis, and a rib extending along the first stage separator axis and projecting towards the first stage separator axis from the wall along a rib tip line;

a second stage cyclonic separator downstream from the first stage cyclonic separator, the second stage cyclonic separator configured to separate debris from the airflow;

a first stage collector configured to receive debris from the first stage cyclonic separator; and a second stage collector configured to receive the debris from the second stage cyclonic separator, the second stage collector being within the first stage collector, the second stage collector having a polygonal cross section taken normal to the first stage separator axis that includes a plurality of vertices, wherein a vertex line extends between a vertex of the plurality of vertices and the first stage separator axis, and wherein the rib tip line and the vertex line are aligned with each other such that the rib is aligned with the vertex.

2. The vacuum cleaner of claim 1, wherein the cross section of the second stage collector has at least three vertices.

3. The vacuum cleaner of claim 2, wherein the cross section of the second stage collector is a square.

4. The vacuum cleaner of claim 1, further comprising a shroud forming a passageway between the first stage cyclonic separator and the second stage cyclonic separator, wherein the first stage cyclonic separator, the second stage cyclonic separator, the shroud, the first stage collector, and the second stage collector are parts of a dust separator assembly, the dust separator assembly having an inlet end and a collection end, wherein the second stage collector extends between the shroud and the collection end of the dust separator assembly.

5. The vacuum cleaner of claim 1, wherein the rib extends radially towards the first stage separator axis from the wall.

6. The vacuum cleaner of claim 1, further comprising a shroud forming a passageway between the first stage cyclonic separator and the second stage cyclonic separator, the shroud including a skirt, wherein a gap is defined between the skirt and the wall, wherein the rib includes a rib tip, the rib tip being closest to the first stage separator axis, the rib extending a rib dimension to the rib tip, the rib dimension being larger than the gap between the wall and the skirt.

7. The vacuum cleaner of claim 1, wherein the vacuum cleaner further comprises a shroud, and wherein the first stage cyclonic separator, the second stage cyclonic separator, the first stage collector, and the second stage collector are parts of a dust separator assembly, the dust separator assembly having an inlet end and a collection end, wherein the shroud forms an air passageway between the first stage cyclonic separator and the second stage cyclonic separator, the shroud including a skirt with a surface proximal the collection end of the dust separator assembly, the rib projecting from the collection end to a position between the collection end and the surface defining a void between the surface and the rib.

8. The vacuum cleaner of claim 1, further comprising a cylindrical housing that surrounds the first stage separator axis, the cylindrical housing including the first stage cyclonic separator and the first stage collector.

9. The vacuum cleaner of claim 1, wherein the second stage collector is positioned centrally within the first stage collector.

10. The vacuum cleaner of claim 1, wherein in a plane normal to the first stage separator axis, a first circle bounded by interior surfaces of the first stage collector has a first diameter and a second circle bounded by interior surfaces of the second stage collector has a second diameter, wherein the second diameter is between 20% and 50% of the first diameter.

11. The vacuum cleaner of claim 1, wherein the rib extends to a rib tip being closest to the first stage separator axis, the rib extending a rib dimension to the rib tip, and the vacuum cleaner further comprises a shroud forming a passageway between the first stage cyclonic separator and the second stage cyclonic separator, the shroud including a skirt, the skirt defining a surface proximal the rib, and a void between the surface of the skirt and the rib, the void defining a length between the surface of the skirt and the rib in a direction parallel to the first stage separator axis, wherein the length of the void is between 0% and 200% of the rib dimension.

12. The vacuum cleaner of claim 11, wherein the length of the void is between 25% and 125% of the rib dimension.

13. The vacuum cleaner of claim 11, wherein a gap is defined between the skirt and the wall and the rib dimension is larger than the gap between the wall and the skirt.

14. The vacuum cleaner of claim 13, wherein the rib dimension is between 0% and 50% larger than the gap between the wall and the skirt.

15. The vacuum cleaner of claim 14, wherein the rib dimension is between 15% and 35% larger than the dimension of the gap.

16. The vacuum cleaner of claim 13, wherein the rib is a single rib extending along the first stage separator axis and projecting towards the first stage separator axis from the wall along the rib tip line.

17. The vacuum cleaner of claim 16, further comprising a shroud forming a passageway between the first stage cyclonic separator and the second stage cyclonic separator, the shroud including a skirt, wherein a gap is defined between the skirt and the wall, wherein the rib includes a rib tip, the rib tip being closest to the first stage separator axis, the rib extending a rib dimension to the rib tip, the rib dimension being larger than the gap between the wall and the skirt.

18. The vacuum cleaner of claim 17, wherein the skirt defines a surface proximal the rib, and the vacuum cleaner further includes a void between the surface of the skirt and the rib, and the void defines a length between the surface of the skirt and the rib in a direction parallel to the first stage separator axis, the length of the void is between 0% and 200% of the rib dimension.

19. The vacuum cleaner of claim 18, wherein the length of the void is between 25% and 125% of the rib dimension.

20. The vacuum cleaner of claim 19, wherein the rib dimension is larger than the gap between the wall and the skirt.

21. The vacuum cleaner of claim 20, wherein the rib dimension is between 0% and 50% larger than the gap between the wall and the skirt.

22. The vacuum cleaner of claim 21, wherein the rib dimension is between 15% and 35% larger than the gap between the wall and the skirt.

* * * * *